United States Patent [19]

Koppers

[11] 4,089,181

[45] May 16, 1978

[54] CANOPY AND SHIELD STRUCTURE FOR SUPPORTING A SHIELD IN A SEAM-LIKE MINE DEPOSIT

[75] Inventor: Manfred Koppers, Duisburg, Germany

[73] Assignee: Thyssen Industrie AG, Germany

[21] Appl. No.: 775,197

[22] Filed: Mar. 7, 1977

[30] Foreign Application Priority Data

Apr. 17, 1976 Germany ..... 2617141

[51] Int. Cl.[2] ..... E21F 5/06

[52] U.S. Cl. ..... 61/45 D; 299/11

[58] Field of Search ..... 61/45 D; 299/11

[56] References Cited

U.S. PATENT DOCUMENTS

| | | | |
|---|---|---|---|
| 3,903,703 | 9/1975 | Lubojatsky | 61/45 D |
| 3,916,631 | 11/1975 | Agnew et al. | 61/45 D |
| 4,027,489 | 6/1977 | Walker et al. | 61/45 D |

*Primary Examiner*—Jacob Shapiro
*Attorney, Agent, or Firm*—McGlew and Tuttle

[57] ABSTRACT

A canopy and shield structure for supporting a shield adjacent a working face in a seam-like mine deposit, comprises a floor skid which is connected through an extensible and retractable prop at the working face end to the working face, and of a canopy, which is adapted to be positioned in parallel relation to the roof strata. The working space is covered at the waste removal end by a shield which includes a lower portion pivotal on the floor skid, and an upper portion which is rigidly connected to the canopy at the opposite end of the canopy from the working face end. The shield is connectable to an extensible and retractable prop and a lemniscate guidance mechanism, so that the upper part of the shield may be moved upwardly and downwardly along its longitudinal axis. The upper part also carries an opening for the passage of a blast pipe which is supported on roller means carried by the canopy.

2 Claims, 2 Drawing Figures

CANOPY AND SHIELD STRUCTURE FOR SUPPORTING A SHIELD IN A SEAM-LIKE MINE DEPOSIT

FIELD AND BACKGROUND OF THE INVENTION

The present invention relates in general to the construction of mine shields and, in particular, to a new and useful combined canopy and shield structure for a supporting shield in a seam-like mine deposit.

DESCRIPTION OF THE PRIOR ART

German Pat. No. P 26 05 068.0-24, filed Feb. 10, 1976 relates to a canopy and shield structure for a supporting shield in seam-like deposits, including a floor skid, at least one propping member resting against the skid and supporting a roof canopy which extends up to the working face, and a shield which extends from the waste discharge end of the canopy to the waste discharge end of the floor skid. The principal inventive feature disclosed therein is that the shield comprises two parts which are pivoted to each other, of which the upper part has its free end hinged to the canopy and extends perpendicularly to the stratification in any position of the shield, while the lower part has its free end hinged to the floor skid and extends obliquely downwardly toward the worked-out area.

SUMMARY OF THE INVENTION

The present invention is an improvement of the inventive idea of the aforementioned patent, and is directed to an additional objective of making it possible to move the canopy and the upper part of the shield vertically and not along an arc of circle, while adjusting the structure to varying thicknesses of the seam.

To this end and in accordance with the invention, the upper part of the shield is rigidly connected to the canopy at the waste discharge end thereof and is movable in the direction of its own longitudinal axis by means of a lemniscate guidance, which is known per se.

Preferably, in accordance with the invention, the canopy and the upper part of the shield rigidly connected thereto form a right angle which is open toward the floor skid.

In a further development, the invention provides that roller-, slide-, or cable guides are mounted in the corner between the canopy and the upper part of the shield, in order to make it possible to displace a blast line horizontally and vertically with the aid of mechanical or hydraulic means.

The advantage offered by the invention is that, during the advance step in the direction of the working face, the blast line is moved first as a whole and, thereupon, the supporting shield structures are advanced. With all the supporting structures and the blast line in their new positions, the lateral discharge outlet of the blast line is again located in front of the opening which is provided in the upper part of the supporting shield. A further advantage is that, not only the free extremity of the canopy is displaced vertically, but also along therewith, the upper part of the shield, so that during the adjustment of the individual supporting structures to a greater thickness of the seam, the blast line can temporarily remain in its hiterto occupied position and is displaced vertically upwardly as a whole into its new position only after all the shield structures have been adjusted. Due to the provision of roller-, slide-, or cable guides, the blast line can be advantageously moved in several directions, for example, lowered vertically onto the floor skid, into a more conventient position for accelerating repairs.

Accordingly, it is an object of the invention to provide a canopy and shield structure for supporting a shield adjacent a working face in a seam-like mine deposit having a roof stratification, which comprises a floor skid having a prop connected to the forward end which is extensible and retractable and which is pivotally connected at its upper end to a roof canopy which overlies the skid and is adapted to extend up to the working face of the mine, and which also includes a shield extending between the skid and the roof canopy adjacent the waste removal end which is the end opposite the mine face, and which includes an upper substantially vertical part which is rigidly connected to the canopy and pivoted to a lower part and which further includes a lemniscate linkage guide means connected between the upper part and the skid for guiding the upper part for movement in directions extending along its longitudinal axis.

A further object of the invention is to provide a canopy and shield structure which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

DESCRIPTION OF THE PREFERRED EMBODIMENT

Figure 2:
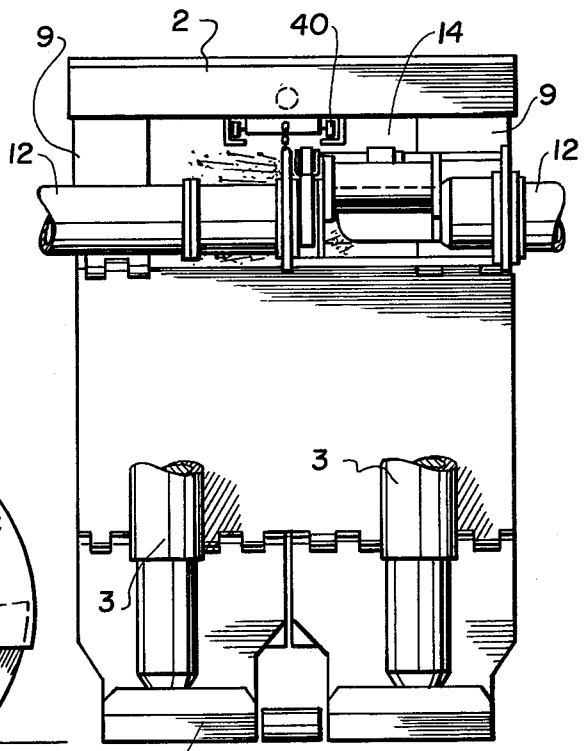
FIG. 2 is an end elevational view, on the waste removal side, of the structure shown in FIG. 1.
Figure 1:
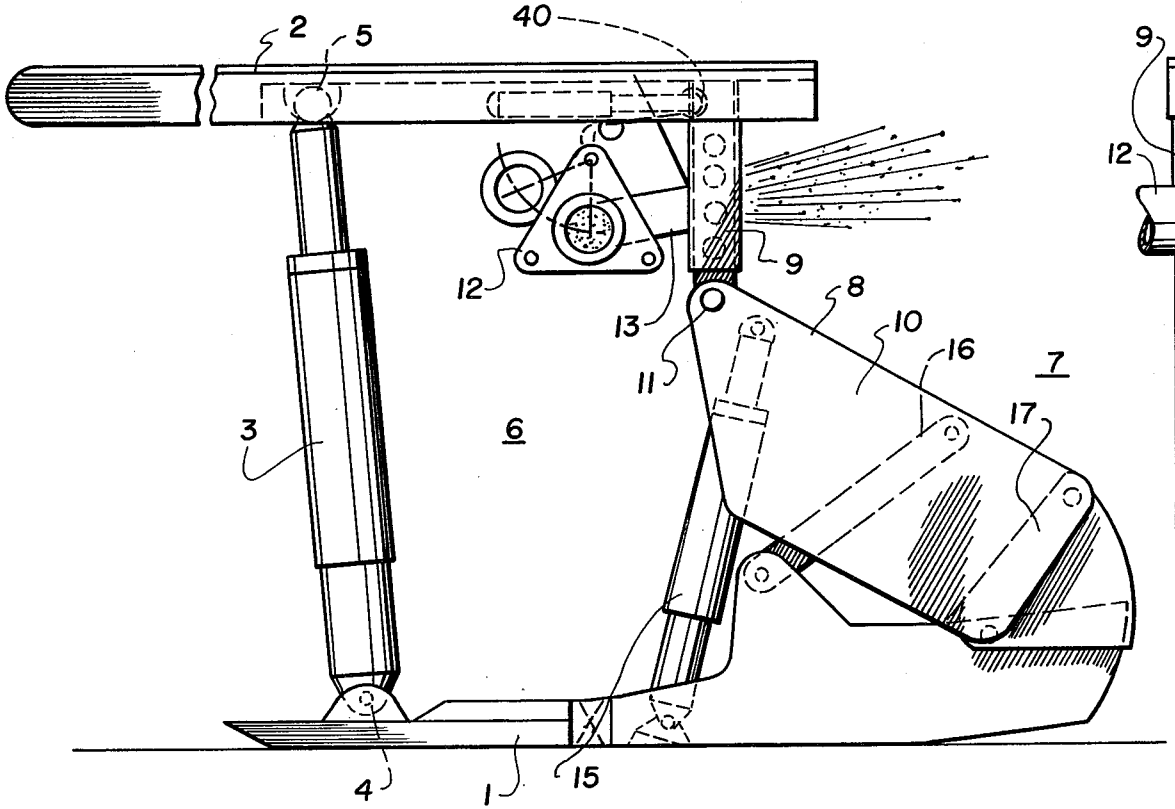
FIG. 1 is a side elevational view of a canopy and shield structure constructed in accordance with the invention.

Referring to the drawing in particular, the invention embodied therein, comprises a canopy and shield structure which is capable of being advanced stepwise in a mine against a working face thereof, and which is adapted to be associated with a blast conduit which extends through the shield and which has mechanically actuated lateral discharge outlets.

The supporting shield structure comprises a floor skid 1, a roof canopy 2 and a hydraulic prop 3 for bracing the canopy 2, which is hinged at 4 to the floor skid and at 5 to the canopy.

A shield, generally designated 8, separates the working space 6 from the worked-out area 7, and it includes an upper part 9 and a lower part 10. The two parts 9 and 10 are hinged to each other at 11. The free end of upper part 9 is rigidly connected to a canopy or roof cap 2 and forms therewith a right angle. In the corner formed thereby, a blast line 12 is suspended for horizontal and vertical displacement in roller guides 40. A blast line or blow line 12 is provided with a lateral discharge outlet 13 which can be swung into a position in front of an opening 14 provided in upper part 9 of shield 8. Lower part 10 of shield 8 is supported by a piston-and-cylinder mechanism 15 which is hinged to this lower part and to the floor skid 1. Two levers 16 and 17 form a lemniscate guidance permitting a vertical parallel displacement and ensuring a continuously correct position of the lateral discharge outlet 13 of blast line 12 in front of opening 14 provided in upper part 9 of shield 8.

While a specific embodiment of the invention has been shown and described in detail to illustrate the application of the principles of the invention, it will be understood that the invention may be embodied otherwise without departing from such principles.

What is claimed is:

1. A canopy and shield structure for supporting a shield adjacent a working face in a seam-like mine deposit with a roof stratification, comprising a floor skid, a roof canopy overlying said skid having a working end and adapted to extend up to the working face of the mine deposit and having an opposite end extending away from the face, a fluid pressure-operated extensible and retractable prop having an upper end pivotally connected to said roof canopy adjacent the operating face end and an opposite end pivotally connected to said skid, and a shield extending between the opposite end of said roof canopy and said floor skid and including a lower part having a lower end pivotally connected to said floor skid and having an opposite upper end, and an upper shield part rigidly connected to said roof canopy adjacent said opposite end of said roof canopy and also connected to said upper end of said lower shield part, and a lemniscate linkage guide means connected between said lower part and said skid for guiding said upper part for movement to effect movement of said upper shield part substantially in a vertical direction.

2. A canopy and shield structure, according to claim 1, wherein said upper part of said shield has an opening therethrough for a blast line and support means carried by said canopy for supporting a blast line for movement relative to the upper part of said shield.

* * * * *